US005340106A

United States Patent [19]

Ravaris

[11] Patent Number: 5,340,106

[45] Date of Patent: Aug. 23, 1994

[54] MOMENT OF INERTIA GOLF PUTTER

[76] Inventor: Paul A. Ravaris, 5301 Overton Ridge Blvd., Apt. 111, Fort Worth, Tex. 76132

[21] Appl. No.: 65,940

[22] Filed: May 21, 1993

[51] Int. Cl.[5] ..... A63B 53/04

[52] U.S. Cl. ..... 273/164.1; 273/167 G; 273/167 A; 273/167 J; 273/80 C

[58] Field of Search ..... 273/167 R, 168, 78, 273/169, 170, 171, 172, 173, 174, 175, 167 A, 167 B, 167 C, 167 D, 167 E, 167 F, 167 G, 167 H, 167 J, 167 K, 77 A, 164.1, 193 R, 194 R, 80 C; D21/214–218

[56] References Cited

U.S. PATENT DOCUMENTS

| | | | |
|---|---|---|---|
| D. 217,487 | 5/1970 | Blake | 273/167 R |
| D. 248,783 | 8/1978 | Long . | |
| 1,089,881 | 3/1914 | Taylor | 273/167 A |
| 1,319,802 | 10/1919 | Shea | 273/167 G |
| 1,531,821 | 3/1925 | Scott . | |
| 3,387,845 | 6/1968 | Raub | 273/164.1 X |
| 3,680,868 | 12/1970 | Jacob . | |
| 3,815,921 | 3/1972 | Turner . | |
| 3,912,274 | 10/1975 | Brace | 273/164.1 |
| 3,955,819 | 5/1976 | Yokich | 273/167 A X |
| 4,114,886 | 9/1978 | Koch | 273/167 J X |
| 4,314,701 | 2/1982 | Swanson | 273/167 J X |
| 4,343,472 | 8/1982 | Hamilton | 273/164.1 |
| 4,508,350 | 4/1985 | Duclos | 273/169 X |
| 4,580,784 | 4/1986 | Brill | 273/169 X |
| 4,702,477 | 10/1987 | Solomon . | |
| 4,722,528 | 2/1988 | Tsao . | |
| 4,795,158 | 1/1989 | Kuykendall . | |
| 4,828,265 | 5/1989 | Antonious . | |
| 4,832,344 | 5/1989 | Werner . | |
| 4,834,387 | 5/1989 | Waites | 273/169 X |
| 4,881,737 | 11/1989 | Mullins | 273/175 X |
| 4,999,000 | 3/1991 | Finney . | |
| 5,058,895 | 10/1991 | Igarashi . | |
| 5,078,398 | 1/1992 | Reed et al. . | |
| 5,125,664 | 6/1992 | Evans | 273/167 B X |
| 5,213,329 | 5/1993 | Okumoto | 273/167 AX |

FOREIGN PATENT DOCUMENTS

| | | | |
|---|---|---|---|
| 2255287 | 11/1992 | United Kingdom | 273/167 J |

OTHER PUBLICATIONS

Cochran & Stobbs, "The Search for the Perfect Swing", Copyright 1968 by the Golf Society of Great Britain, pp. 128–142.

*Primary Examiner*—Mark S. Graham
*Assistant Examiner*—Sebastiano Passaniti
*Attorney, Agent, or Firm*—Geoffrey A. Mantooth

[57] ABSTRACT

Described herein is the specification for a golf club, specifically a putter, with an improved moment of inertia and improved sole to reduce the adverse effects of grounding the club head. The putter increases peripheral weighting relative to the center of gravity by incorporating a non-rectangular shaped face. The improved face shape redistributes unused material along the face to the peripherally located toe and heel. Increasing the peripheral weighting increases the putter moment of inertia thereby reducing the adverse effects of striking the ball away from the center of gravity. The improved sole design provides runners to reduce the adverse effect of grounding the club head during the putting via a flat surface aligned to the arc of the stroke.

10 Claims, 9 Drawing Sheets

MOMENT OF INERTIA GOLF PUTTER

FIELD OF THE INVENTION

This invention relates to golf club design, more specifically to an improved moment of inertia putter that reduces twisting, coupled with an improved sole to reduce the adverse effects of club grounding during the putting stroke.

BACKGROUND OF THE INVENTION

Many golf games are lost on the putting green. This is because many golfers are able to satisfactorily drive or chip the ball onto the green, only to take too many putting strokes in finally sinking the ball. In recent years it has been suggested that improved putting accuracy can be obtained by increasing the club head moment of inertia and aligning the striking point (the point where the club head strikes the ball, also known as the "sweet spot") with the center of gravity of the club head. When the club head strikes the ball away from the head's center of gravity, a moment (also called a torque) is imparted on the club head around the center of gravity. The magnitude of this moment is the impact force multiplied by the distance between the impact point and the center of gravity. This force acts to twist the club such that the face is no longer perpendicular to intended line of travel of the putting stroke, thereby causing the golf ball to be pushed by the club head in a nonintended direction and reducing accuracy.

The magnitude of this misdirected force can be reduced by minimizing the distance between the sweet spot and center of gravity (i.e. aligning the sweet spot with the center of gravity). An example of prior art that typifies this method is U.S. Pat. No. 5 078 398. However, simply aligning the sweet spot with the center of gravity alone will not always improve accuracy because every time a miss-hit occurs (a miss-hit is when the ball is struck away from the sweet spot) the twisting force will be present. The impacts of this force can be minimized by increasing the club head moment of inertia. Inertia is the physical property of a body in motion to resist change. Moment of inertia is a measurement of this property. The larger a club head's moment of inertia, the less it will be affected by the force generated from striking the ball away from the center of gravity. These effects can be described by the following equations where angular acceleration is a measure of the club head twisting motion.

$$\text{Torque} = (F)\,(d)$$

$$\text{Angular Acceleration} = (F)(d)/(\text{Moment of Inertia})$$

where:

F = Impact force $d$ = distance between strike point and center of gravity.

The amount of club head inertia is governed by the weight of the club head and the position of that weight relative to the club head center of gravity.

Many prior putters, U.S. Pat. Nos. 5,058,895 and 4,999,000 for example, have increased moment of inertia by adding peripheral weighting using high density materials. However, there is a limit to the amount and position of the weight that can be added. As the putter gets larger and heavier it loses "feel". Feel is the golfer's ability to control the impact force with the ball and the feedback the club gives the golfer about the quality of the stroke. These limits are characterized by the majority of commercially available putters having a face length of 5.5 inches or less and a weight between 280 and 320 grams.

Therefore it becomes imperative to shape the club head to maximize moment of inertia within total club head weight and size restraints. Herein lies one advantage of this invention over prior art. Described herein is a club head with increased moment of inertia which is achieved by tailoring the shape of the striking face. No prior art has tailored the club face of a putter to increase moment of inertia. The closest example of prior art is U.S. Pat. No. 4,828,265 where the face of a driver is shaped to increase club head speed by increasing dynamic pressure at the rear of the club.

Another problem encountered during putting is grounding the putter head into the green short of the ball. A normal putting stroke is characterized by keeping the wrist and arms rigid and pivoting through the shoulders. The distance from a point centered between the shoulder (center point of the arc of the putting stroke) and the sole or bottom of the putter is the radius of the putting stroke. For the average golfer this distance is approximately 48 inches. If a golfer drops his shoulders just a 0.10 inch during a putting stroke, the putter head will impact the ground 3.1 inches behind the intended point of contact with the ball (commonly known as scuffing or grounding the putter). Various methods of reducing the impacts of grounding the club have been advanced, including units which provide rollers to reduce friction, units to vertically align the sweet spot, units with soles configured to reduce the effects of grounding, and units with runners protruding from the sole.

U.S. Pat. No. 3,680,868 is typically of putters with rollers to reduce friction. U.S. Pat. No. 4,832,344 presents a sole protrusion as a means to vertically align the sweet spot of the club and reduce friction with the ground. U.S. Pat. No. 3,815,921 shows a protrusion from the sole as a means to reduce the divot on a driver. However, the protrusions on both these patents are too abrupt to effectively reduce the adverse effects of grounding the club head. U.S. Pat. No. 1,531,821 has two curved runners protruding from the sole to reduce grounding while U.S. Pat. No. 4,722,528 uses a curved leading edge. A curved surface by definition limits the amount of surface area that comes in contact with the ground, so while these designs will reduce the effects of grounding the club head over a sharp leading edge, they are not as effective as a flat surface critically aligned in the arc of the putting stroke as embodied in this invention.

OBJECTS AND ADVANTAGES

The invention introduced herein should prove to be revolutionary in the area of putter design, because it will improve a golfer's putting accuracy and consistency. The invention accomplishes the aforesaid via the following: 1.) a club head with an improved moment of inertia (accomplished by concentrating the bulk of the head weight over the heel and toe, and by centering the "sweet spot" the center of gravity, and the club shaft) 2.) a club head with an improved sole (accomplished via three runners across the sole that are chamfered toward the face and flat along the bottom such that the club will not "catch" during an imprecise stroke).

The present invention relates to a golf club head, specifically a putter, with construction to improve club head moment of inertia.

It is believed that no prior putter has taken the approach of increasing the moment of inertia by tailoring the shape of the hitting face to maximize the peripheral weighting of the club head. Nor has the prior art critically aligned flat sole runners to reduce the adverse impacts of grounding the club head. Based on the theories presented, it is believed this invention provides a substantial advance by increasing the club head moment of inertia and putting consistency, It is further asserted that the features of this invention taken together or separately can improve the performance of other prior art.

BRIEF DESCRIPTION OF THE DRAWINGS

The invention will be more clearly understood by reference to the description below taken in conjunction with the accompanying drawings herein.

REFERENCE NUMERAL IN DRAWINGS

Figure 1:
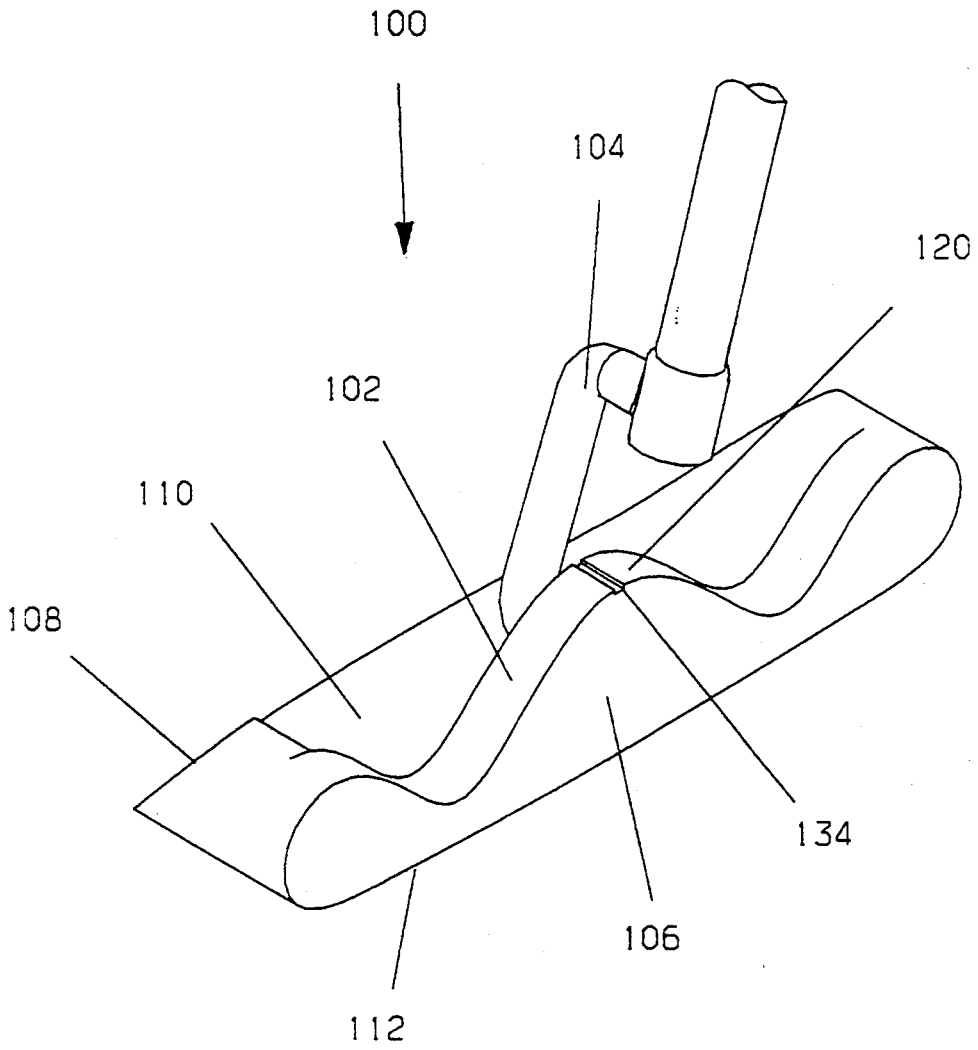
FIG. 1 shows a front perspective view of the putting head of this invention in accordance with a preferred embodiment.

100: golf club putter
102: club head
104: hosel
106: face
108: rear surface
110: top surface
112: sole
114: toe
116: heel
118: back
120: alignment surface
122: hosel piece, "C" shaped
124: hosel barrel
126: hosel barrel bore
128: reinforced portion where hosel connects to the head
130: cavity
132: rear wall of cavity 130
134: alignment groove
136: toe transition surface
138: heel transition surface
140: toe runner
142: center runner
144: heel runner
146: flat portion of toe runner
148: flat portion of center runner
150: flat portion of heel runner
152: angled portion of toe runner
154: angled portion of center runner
156: angled portion of heel runner

Points

200: high point of front face
202: toe side low point of front face
204: heel side low point of front face
206: toe side point defining striking area width
208: heel side point defining striking area width
210: impact point with ball

DESCRIPTION OF PREFERRED EMBODIMENTS

FIG. 1 is an illustration of a putter golf club depicted by reference number 100. The putter head 102 is connected to a shaft via the hosel 104. The head 102 is generally comprised of a ball striking surface called the face 106, a rear surface 108, top surface 110, and bottom surface or sole 112. Better depicted in FIG. 2, the head 102 also embodies a toe 114 and heel 116 which provides perimeter weighting, a back 118, and alignment surface 120.

Figure 2:
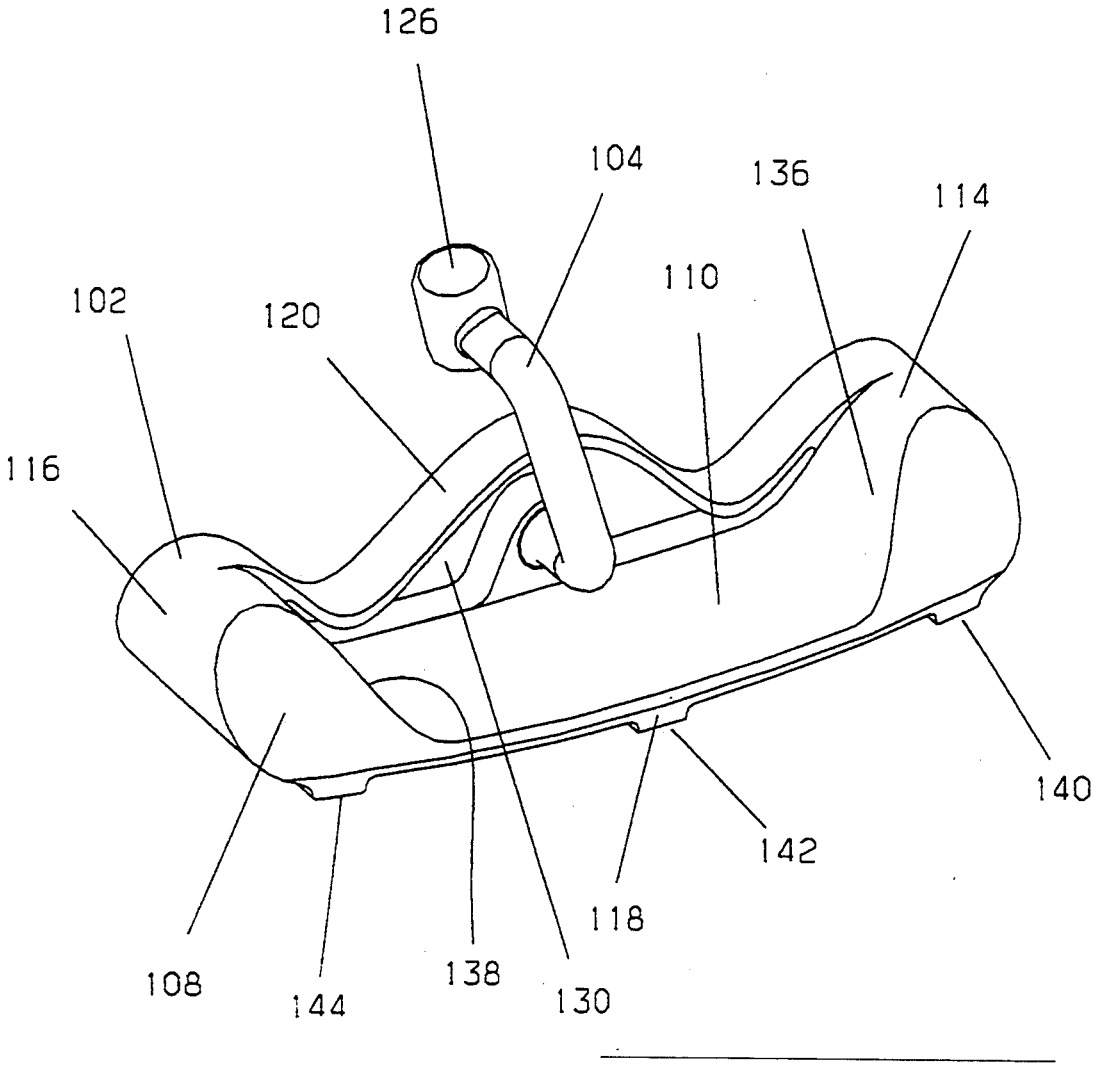
FIG. 2 shows a rear perspective of said invention.
Figure 6:
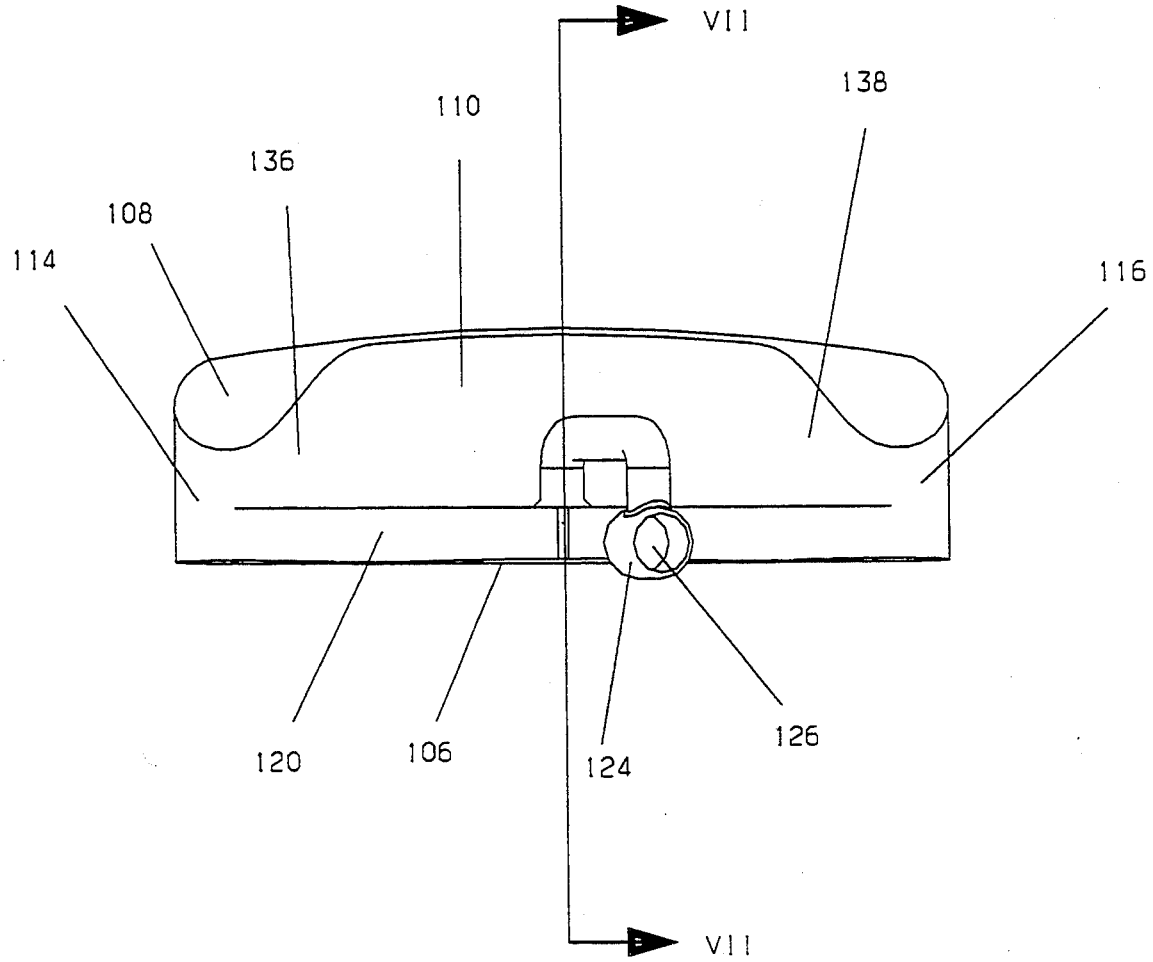
FIG. 6 shows a top view of the club.
Figure 7:
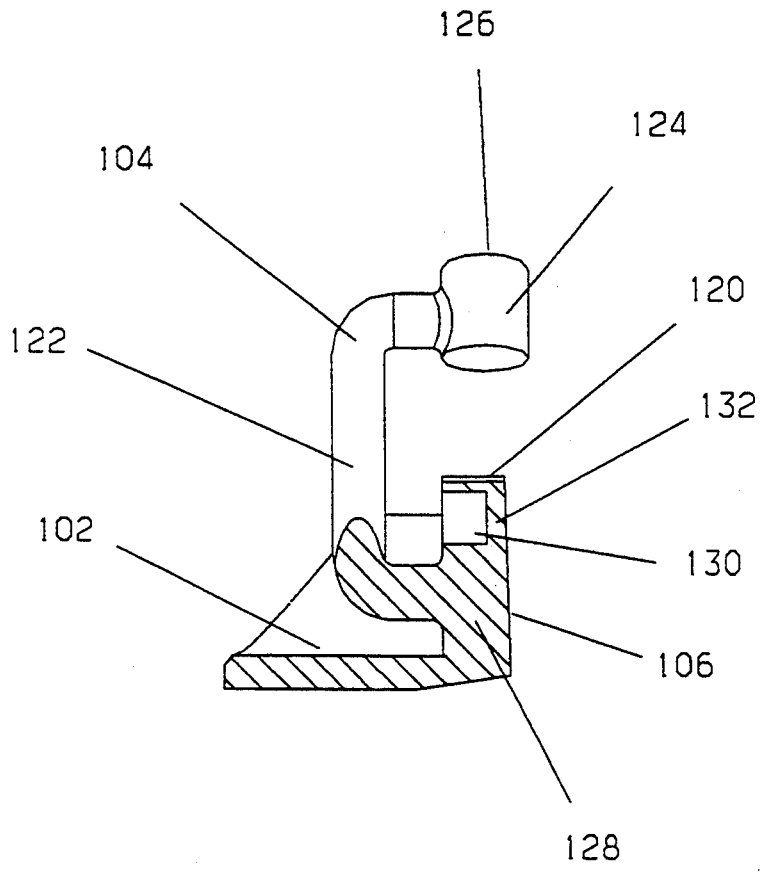
FIG. 7 shows a section view of the club in the direction of the lines VII—VII of FIG. 6.

Referring to FIG. 7, the hosel 104 is comprised of a "C" shaped piece 122 with a hosel barrel 124 having a bore 126 to accept the putter shaft. The hosel 104 is connected to the head 102 via a reinforced portion 128 of the backside of the face 106. The rest of the backside of the face 106 is hollowed out to form cavity 130 having cavity wall 132. Referring to FIGS. 1 and 2, the alignment surface 120 runs along the top forward portion of the head and becomes an integral part of the toe 114 and heel 116. The surface 120 provides a broad surface for the alignment groove 134 and stiffens the thin cavity wall 132, as shown in FIG. 7. The alignment groove 134 gives the user a feature to properly align the center of gravity of the head 102 with the ball. The head 102 is configured such that the center of gravity is in the vertical plane created by section cut VII—VII (see FIG. 6) directly below the alignment groove 134. The hosel piece 122 also connects with 128 in the same plane created by section VII—VII This results in a configuration that minimizes the distance between the strike point and the center of gravity. Further, since the strike point and the center of gravity are in the same plane VII—VII, a ball hit directly on the impact point will result in no angular acceleration at all (that is no twisting of the head 102). The hosel 104 is angled from vertical toward the heel 116 so it will not block the user's line of sight to the alignment groove 134 The hosel 104 has a slight offset, i.e. the shaft interface with the hosel bore 126 is in front of the face 106 (see FIG. 6). The position of the hosel is not critical to the preferred embodiments of the invention. Increasing the offset or providing an onset (hosel 104 behind face 106) design are variations available based on user preference.

Peripheral weighting is obtained by the concentration of material or mass in the toe 114 and heel 116. Referring to FIG. 2, two surfaces 136 and 138 transition the toe and heel to the thin top surface 110. The top surface 110 uses the minimum amount of material necessary to provide rigidity and strength to the head. It can be seen that the toe 114 and heel 116 are substantial in mass compared to the top surface 120 and face 106 and therefore make up the majority of the head weight. Total weight of the head 102 is controlled by the angle of the rear surface 108. The present design weighs 300 grams with a rear surface angle of 40 degrees from vertical. The quoted weight is based on a homogeneous steel investment casting. However, a number of varying density materials could be used, such as tungsten or lead. An aluminum casting with hollow areas in the heel and toe for lead or tungsten is example of a possible non-homogeneous configuration.

Figure 3:
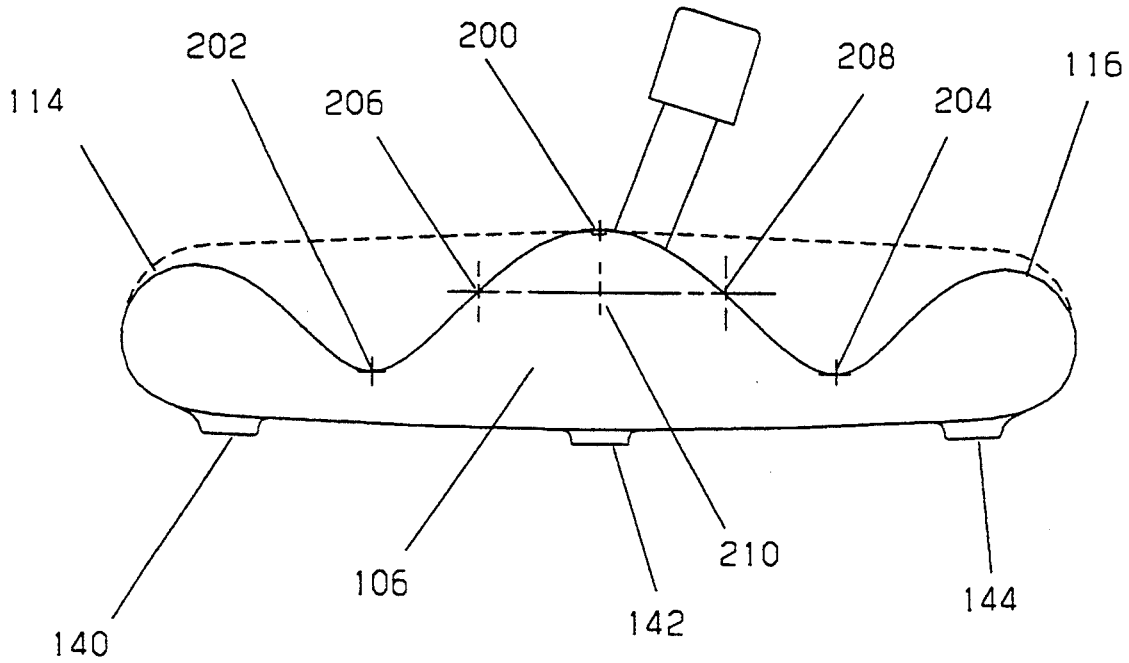
FIG. 3 shows a front view.
Figure 9:
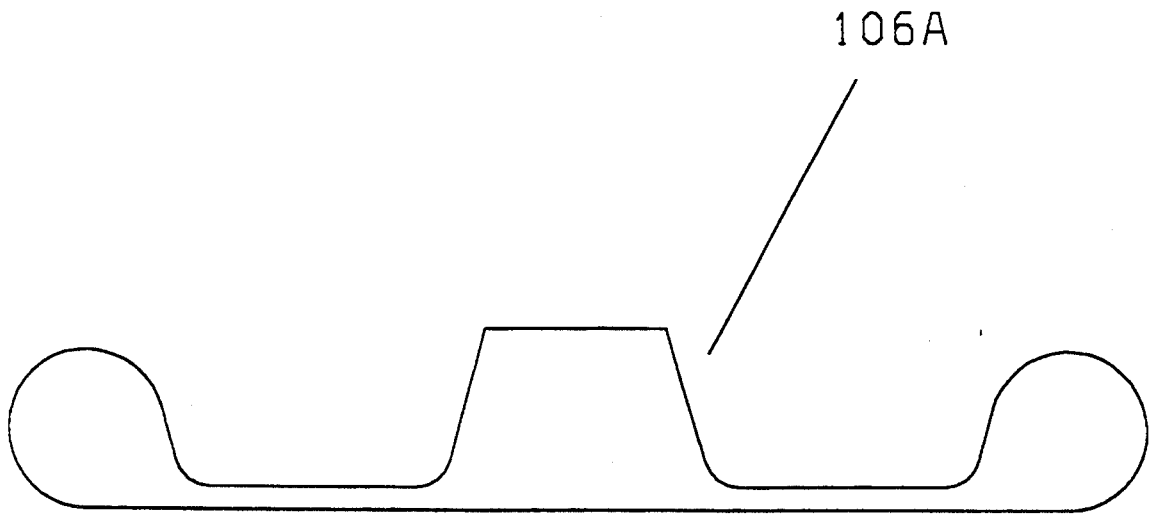
FIG. 9 shows a front view of the club head in accordance with another embodiment.

In order to further increase the moment of inertia, the presented invention takes advantage of the fact that only a small portion of the face 106 actually contacts the ball. Referring to FIG. 3, the prior art faces are generally rectangular as shown by the dashed line. Such prior art is typified by U.S. Pat. Nos. 4,999,000, 5,058,895 and 5,078,398. In the present invention, the face 106 is not generally rectangular, but is provided with notches. The face 106 transitions from a high point 200 to two low points 202 and 204. As can be seen, the non-rectangular face allows a significant amount of unused material, and therefore weight, to be removed from the face and added to the toe 114 and heel 116. Further, the small hitting area allows the wall 132 thickness to be less than prior art typified by U.S. Pat. No. 4,999,000, moving more material to the periphery. Sufficient material is left around the impact point to allow for a miss-hit. In the configuration shown, there is approximately 0.5 inches of material on each side of the strike or impact point 210 giving a hitting width of 1.0 inch (the distance between points 206 and 208). The configuration shown is just one of a number of faces that can increase inertia. For professional golfers with very consistent putting strokes, the distance between 206 and 208 can be smaller. A face 106A shape as shown in FIG. 9 also provide means to move unused face material to the peripheral. Presented are just two of a nun%her of different face shapes that could achieve increased inertia. Therefore, the present invention is not limited to the putter design depicted herein, but can be used with various different shaped putters. The only requirement being a face that allows material to be added to the toe and heel areas so as to achieve a high moment of inertia.

Figure 4:
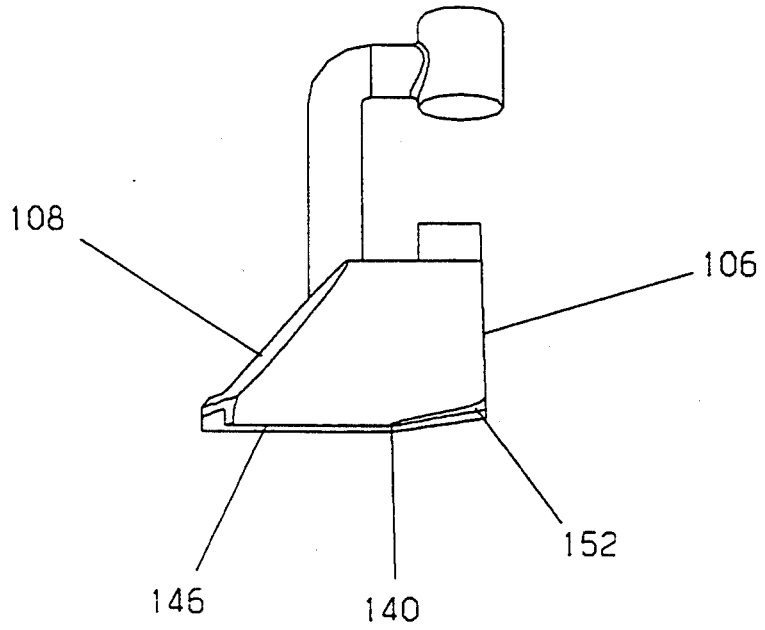
FIG. 4 shows an end view of the club looking from the toe.
Figure 5:
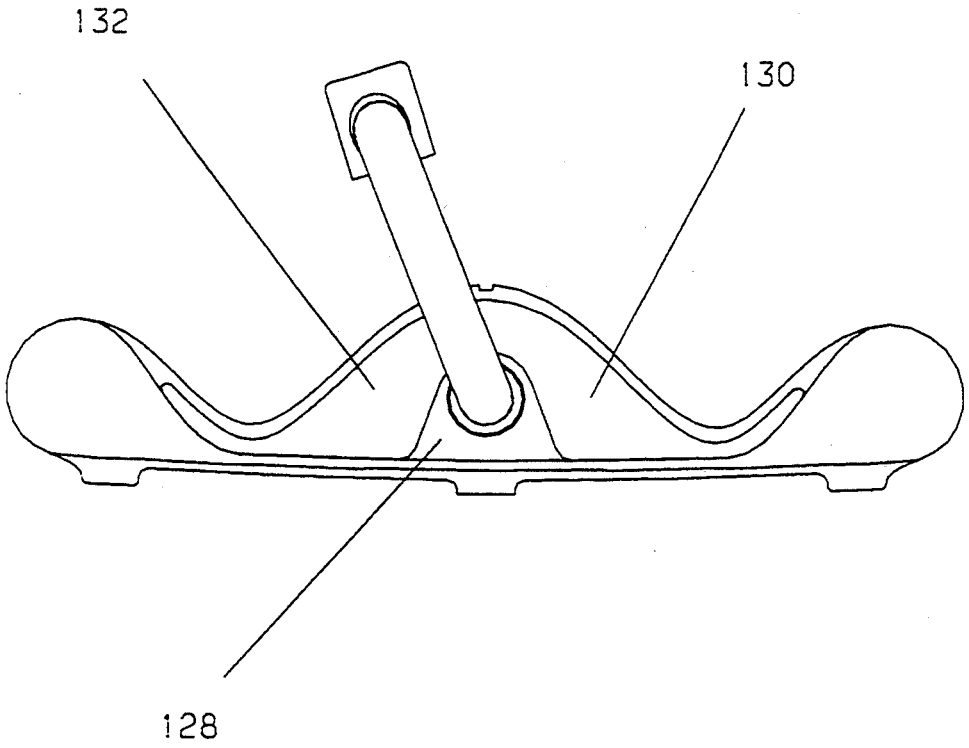
FIG. 5 shows a view of the rear of the club.
Figure 8:
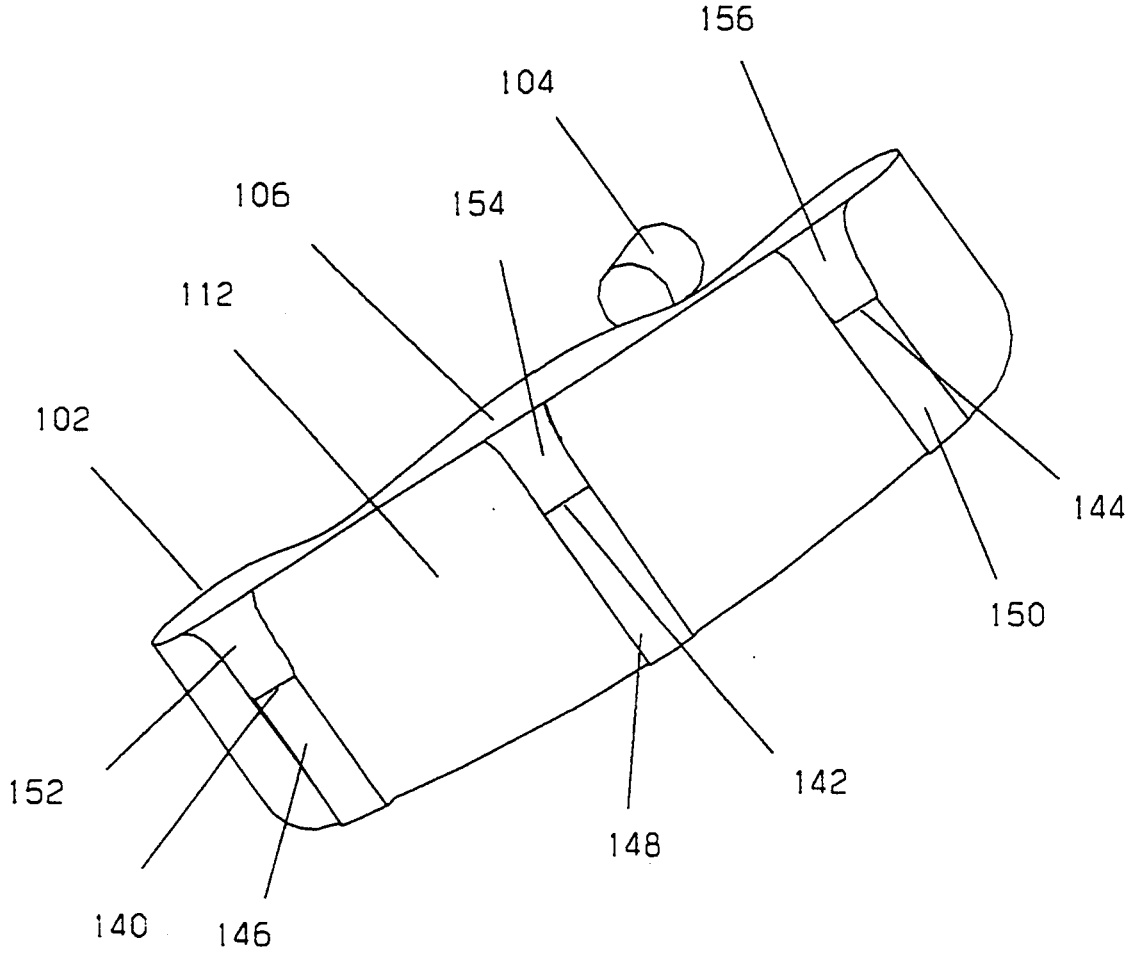
FIG. 8 shows a bottom perspective view of the club head.

Referring to FIGS. 4 and 8, the sole 112 of head 102 has three runners protruding therefrom. These runners, toe runner 144, center runner 142, and heel runner 140 are comprised of flat portions 150, 148, and 146, respectively, parallel to the sole, and angle surfaces 156, 154, and 152 respectively. Since each runner performs the same function, only the toe runner 144 will be discussed in detail. At a point 0.5 inches from the face 106 the flat portion 150 transitions to the angled surface 156. The angled surface is a complex surface that becomes integral with the curvature of the sole 112 at the face 106. This effectively creates a skid for the head to ride upon. The purposes of this skid or runner is to minimize the adverse effects of grounding the putter head. Grounding the putter is a term used to describe the club head hitting the ground behind the ball. Grounding the club is caused by a drop of the shoulder during the putting stroke. The mechanics of the putting stroke are such that the arms and wrists remain rigid while the swing pivots around a point centered between the shoulders (i.e. the center of the arc of the putting stroke). As stated before, if the golfer drops his shoulders 0.1 inches during the stroke the club head will impact the ground 3.1 inches behind the intended point of contact with the ball (FIG. 8). Generally, in putters without runners, the sole and face meet at a right angle that forms a sharp edge. If the shoulders drop during the putting stroke, this sharp edge effectively digs into the ground and stops or disrupts the putting stroke. The surface 156 is angled to the sole and face such that there is no longer a right angle at the impact point but a flat surface as shown in FIG. 4. When the club head impacts the ground on the flat surface it continues through the putting stroke riding up the runner thus preventing digging into the ground.

In the preferred embodiment, the flat portion 150 of the runner 144 protrudes from the sole 112 0.080 inches. The angle surface 156 is angled 9 degrees from the flat portions 150. The angled surface 156 is aligned to be parallel to the ground flat as a result of a 0.2 inch drop in the putting arc center or at an impact point of 4.4 inches behind the desired impact point. It is unrealistic for the golfer with practice to drop his center of putting arc more than 0.2 inches, however, a number of different club heads could be constructed with different angles depending on player handicap (a measure of player ability). Should the golfer drop the center of the putting less than 0.2 inches, the subtle transition of the flat runner still provides a large surface to reduce the effects of grounding of putter. Because the runners are so subtle, three runners are employed. A slight change in the position of the wrists during the putting stroke would allow the toe or heel to impact the ground. With the runners 140, 144, this would have a worse impact than grounding the center of the club head because not only does it disrupt the flow of the stroke but also imparts a twisting motion.

From the foregoing, it is believed that the advantages of the described invention, over previous art, have been clearly presented. Further, it is to be understood that while the preferred embodiments have been described in relation to said invention they should not be limited by that invention, but by the appended claims and legal equivalents.

I claim:

1. A golf club head, comprising:

a) a face having a center portion;

b) a toe and a heel coupled to said face and located peripherally of said face;

c) a sole located along a bottom portion of said face, and a wall located between said top surface and said sole, said wall having a rear surface which is located laterally of said face;

d) a top surface located along a top portion of said face, said top surface having first and second notches therein, said first notch being located between said face center portion and said heel and said second notch being located between said face center portion and said toe;

a shaft coupled to said wall at a location that is between said face and said rear surface and between said first and second notches.

2. The club head of claim 1, wherein said club head has a mass, the majority of which is concentrated in said toe and said heel so as to increase a moment of inertia of said club head.

3. The club head of claim 1, wherein a cavity is formed by said face center portion and said top surface, said cavity thereby reducing the thickness and mass of said face center portion.

4. The club head of claim 1 wherein said rear surface is inclined with respect to a plane containing said face, with the angle of the inclination being determined according to a predetermined mass of the club head.

5. The club head of claim 1 wherein said shaft further comprises a "C" shaped hosel portion having two ends and a shaft portion where one end of said hosel portion is coupled to said wall and the other end of said hosel portion is coupled to said shaft portion.

6. The club of claim 5 wherein said one end of said hosel portion is coupled to a projection that is coupled to said wall.

7. The club of claim 6 further comprising a cavity located between said top surface and said projection.

8. The club of claim 5 further comprising a cavity located between said top surface and said wall.

9. A golf club head, comprising:

a) a face having a center portion;

b) a toe and a heel coupled to said face and located peripherally of said face;

c) a sole located along a bottom portion of said face;

d) a top surface located along a top portion of said face, said top surface having first and second notches therein, said first notch being located between said face center portion and said heel and said second notch being located between said face center portion and said toe;

e) plural runners located on said sole, with each runner having flat first and second surface portions, said first surface portion being oriented with respect to said face at an obtuse angle and merging with said sole at said bottom portion of said face, said first surface portion extending from said face towards a rear of said club head where said first surface portion merges with said second surface portion, said second surface portion being raised relative to said sole.

10. The club head of claim 9, wherein said runners comprise a toe runner located adjacent to said toe, a heel runner located adjacent to said heel, and a center runner located adjacent to said face center portion.

* * * * *